United States Patent [19]

Russell

[11] Patent Number: 4,630,557

[45] Date of Patent: Dec. 23, 1986

[54] ADJUSTABLE LOW INERTIA PRESSER BAR

[75] Inventor: Angus R. T. Russell, Englishtown, N.J.

[73] Assignee: The Singer Company, Stamford, Conn.

[21] Appl. No.: 263,623

[22] Filed: May 14, 1981

[51] Int. Cl.[4] ..... D05B 29/02

[52] U.S. Cl. ..... 112/235

[58] Field of Search ..... 112/60, 235, 236, 237, 112/238, 240

[56] References Cited

U.S. PATENT DOCUMENTS

| | | | |
|---|---|---|---|
| 724,322 | 3/1903 | Noble | 112/237 |
| 1,306,752 | 6/1919 | DeVoe | 112/235 |
| 1,487,420 | 3/1924 | Witkus | 112/240 |
| 1,880,749 | 10/1932 | Bowman | 112/235 |
| 2,827,006 | 3/1958 | Rockerath | 112/235 |
| 4,058,071 | 11/1977 | Dunn et al. | 112/235 |

FOREIGN PATENT DOCUMENTS

| | | | |
|---|---|---|---|
| 845812 | 4/1968 | Japan . | |
| 169049 | 10/1959 | Sweden | 112/235 |

*Primary Examiner*—W. C. Reynolds

*Attorney, Agent, or Firm*—Edward P. Schmidt; Robert E. Smith; Edward L. Bell

[57] ABSTRACT

A low inertia presser bar carries a retaining plate which slidably extends through an enlarged slot in a hollow main presser bar that slidably receives the main presser bar. The lowered position of the main presser bar may be adjusted to position the clearance between the slot and retaining plate above the plate, or with a selected portion of this clearance below the plate for adjustable travel of the low inertia presser bar before initiating motion of the main presser bar.

2 Claims, 3 Drawing Figures

ADJUSTABLE LOW INERTIA PRESSER BAR

BACKGROUND OF THE INVENTION

This invention relates to sewing machines; more particularly, it relates to apparatus for controlling the presser foot of such machines.

Sewing machines are generally provided with presser bar mechanisms for maintaining the work material in contact with a feed dog, part of a feeding system for feeding a work material through the sewing machine. The presser bar mechanism generally includes a presser bar terminating in a presser foot which is in contact with the work material. The presser bar is usually spring loaded downwardly to maintain engagement between the work material and the feeding dog, and a lever is provided to elevate the presser bar and foot free of the work material so as to allow removal of the same or adjustment thereof as well as to facilitate insertion of a new work piece.

In a conventional arrangement, the presser foot is urged against the work material by one spring which may be adjusted to provide a light pressure or an extremely heavy pressure, depending upon the heaviness of the fabric and the absence or presence of hurdles comprising stitch joints which must be fed through the sewing machine. As an example, a heavy work material would require substantially more pressure to have a feed dog obtain a grip sufficient to feed the material through the sewing machine. In industrial sewing machines undergoing high speeds, in the neighborhood of 4000 to upwards of 10,000 stitches per minute, it frequently occurs that rising of the feed dogs to the work material for propulsion of the same in a feeding direction will cause the presser bar mechanism to be thrown upward against its spring and maintain a "float" out of actual contact with the work material. This characteristic necessitates increasing the spring loading to the point where this float does not occur. This characteristic has been observed to be due to high inertia parts which, according to physical laws, resist a change in state from being in motion to not being in motion and vice versa. A solution is, of course, to provide a low inertia system which is generally accomplished by having very light weight parts connected to the presser foot which parts are urged by a lightweight spring against the work material. In this low inertia presser system a main presser bar spring is not called into play until a fixed amount of motion has taken place. In the prior art, U.S. Pat. No. 3,863,580, of Feb. 4, 1975, there is an example of a low inertia pressure system which is adjustable to regulate the amount of travel permitted to the low inertia system before calling the main presser bar spring into operation. However, this prior art system is cumbersome and expensive to manufacture and is not readily retrofittable into existing sewing machines.

What is required is a low inertia presser system which is economical and retrofittable into an existing sewing machine and which may have its low inertia travel adjusted to suit the immediate sewing needs of the machine.

SUMMARY OF THE INVENTION

The above requirements have been met in a low inertia presser bar system in which a very low inertia presser bar carries the presser foot and is itself carried in a hollow main presser bar. A low inertia presser bar spring is situated inside the main presser bar and rests upon the low inertia presser bar as urged thereon by a low inertia presser regulating screw threadedly carried by a main presser regulating screw, itself threadedly carried by the arm casting. A retaining plate is attached to the low inertia presser bar and sits in an enlarged slot in the main presser bar. The presser foot and low inertia presser bar may partake of the limited motion permitted by sliding of the retaining plate in the slot in the main presser bar while being subject to the low inertia presser bar spring. The main presser bar slides within a bushing attached to the arm casting to a lower limit determined by a collar carried by the presser bar, and the main presser bar may be lowered to decrease the clearance between the retaining plate and the top of the slot in the main presser bar. Thereby, the amount of upward motion of a presser foot which may take place before the main presser bar is lifted, may be regulated by a sewing machine operator to accommodate the hurdles or cross seams encountered in the work material which may be accommodated by the low inertia presser bar spring.

DESCRIPTION OF THE DRAWINGS

With the above and additional objects and advantages in mind as will hereinafter appear, the invention will be described with reference to the accompanying drawings in which:

Referring now to FIG. 1, there is shown a sewing machine head end 10 partly in section and with certain components removed in order to more clearly display the presser bar system 12 therein. The sewing machine head end 10 overlies a work supporting bed 14 which, as is well known in the sewing machine art, supports therein in the usual fashion a work feeding system normally utilizing feed dogs (not shown) for feeding a work material through the sewing machine. The feed dogs (not shown) are opposed by the presser system 12, specifically by the presser foot 16 supported at the bottom thereof. By referring to FIG. 2, it can be seen that the presser foot 16 is attached by screw 17 to a low inertia presser bar 18. The low inertia presser bar 18 extends into the hollow interior of a hollow main presser bar 20 and is slidably retained therein by means of a retaining plate 22 attached to the low inertia presser foot by screw 23 and situated within a slot 24 in the main presser bar of a height greater than the retaining plate by the maximum possible travel desired for the low inertia presser bar. The main presser bar 20 is carried by a bushing 26 permanently affixed to the sewing machine head end 10. A collar 28 is affixed to the main presser bar 20 and maintained in position by set screw 29 so as to limit the downward travel of the main presser bar through the bushing.

Figure 1:
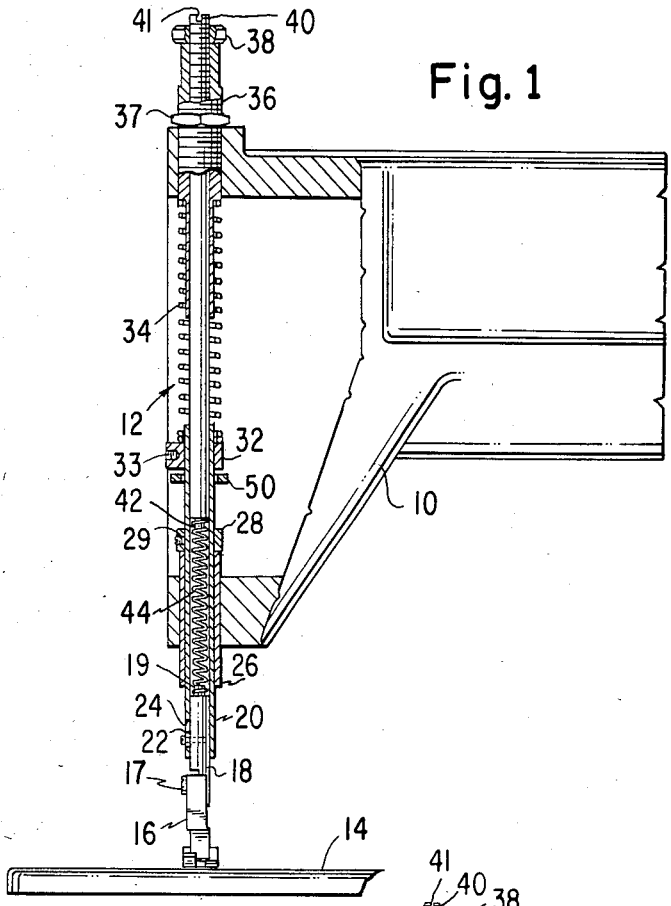
FIG. 1 is a front elevation partly in section of a head end portion of a sewing machine to which the invention has been added.

Affixed to the main presser bar 20, spaced above the collar 28, is a main presser bar guide bracket 32 which is clamped to the main presser bar 20 by a screw 33 and receives the thrust of the main presser bar spring 34.

The main presser bar spring 34 extends upwardly to the end of a main pressure regulating screw 36 which is threadedly carried in the upper reaches of the sewing machine head end coaxially with the main presser bar 20, bushing 26 and low inertia presser bar 18. A lock nut 37 retains the main pressure regulating screw 36 in an adjusted position by frictional engagement with the sewing machine head end 10 and the main pressure regulating screw. A thumb screw portion 38 of the main pressure regulating screw permits turning of the main pressure regulating screw 36 when the lock nut 37 has been loosened so as to attain an adjusted position, which may thereafter be retained by retightening the lock nut.

The main pressure regulating screw 36 is fashioned with a hollow interior which is threaded to receive a threaded portion of a low inertia pressure regulating screw 40 which extends therethrough and into the hollow interior of the main presser bar 20. The upper end of the low inertia pressure regulating screw 40 is slotted 41 to receive the blade of an adjusting screwdriver. The bottom end of the low inertia pressure regulating screw is fashioned with a short reduced diameter portion 42 received in the upper end of a low inertia presser bar spring 44. A similar reduced diameter portion 19 on top of the low inertia presser bar 18 is received in the bottom end of low inertia presser bar spring 44. Thus, the low inertia pressure regulating screw 40 may be adjusted separately of the main pressure regulating screw 36 although carried internally of and coaxially therewith, to adjust the pressure on the low inertia presser bar spring which presses the low inertia presser bar 18 and presser foot 16 attached thereto against the work material carried on the bed 14 of the sewing machine. The main pressure regulating screw 36 is threadedly carried in the upper portion of the sewing machine head end 10 so as to adjustably compress the main presser bar spring 34 extending between the bottom end of the regulating screw 36 and the main presser bar guide bracket 32 affixed to the main presser bar 20.

Figure 2:
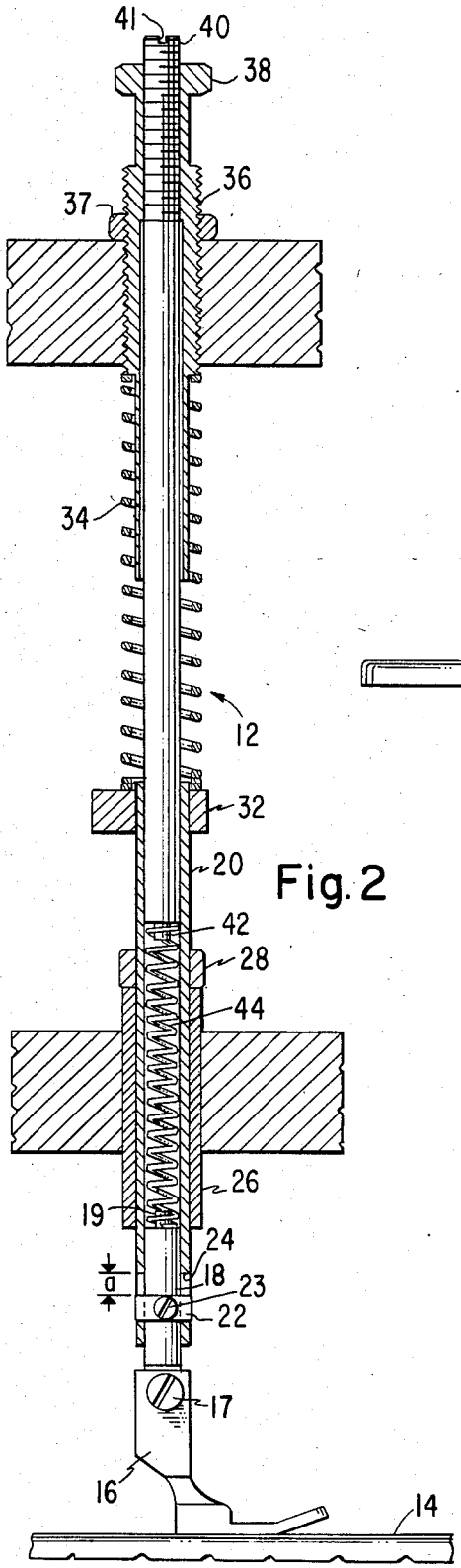
FIG. 2 is a side view of the presser bar arrangement shown in FIG. 1 with the parts thereof arranged for the maximum travel of the low inertia presser bar; and, FIG. 3 is a head end elevation of the sewing machine shown in FIG. 1 with, however, the low inertia presser bar arranged to accommodate a lesser travel thereof prior to initiating operation of the main presser bar arrangement.
Figure 3:
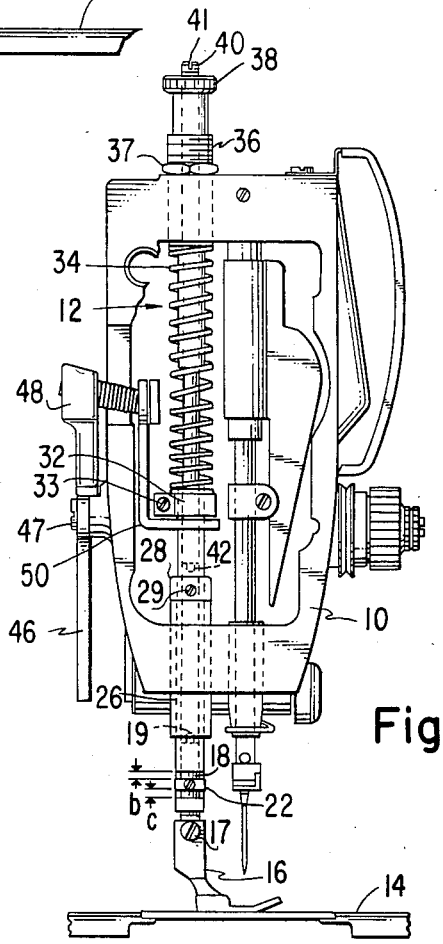

As is shown in FIG. 2, the collar 28 may be affixed to the main presser bar 20 in a position where a maximum gap "a" exists between the top of the slot 24 and the top of the retaining plate 22. With the low inertia pressure system thus adjusted, the low inertia presser bar 18 and presser foot 16 attached thereto are enabled to go over a cross seam of a height equal to "a" without causing a lift of the main presser bar 20, which would compress the main presser bar spring 34. In the event that such a hurdle has unsatisfactory effect upon the feeding of work material, the feed travel of the low inertia pressure system may be adjusted by rotating the presser lifter lever 46 pivoted on the sewing machine head end 10 by screw 47 so as to cam the knee shift lever 48 upwardly. The knee shift lever 48 thereby takes the presser bar lifting bracket 50 upwardly which impinges on the main presser bar guide bracket 32 and raises the main presser bar 20 to an elevated position. At that point, the set screw 29 holding the collar 28 in position on the main presser bar 20 may be loosened and the collar shifted downwardly on the main presser bar to remove free travel from the low inertia presser bar 18. With the set screw 29 once again locking the collar 28 into position on the main presser bar 20 the presser bar lifting lever 46 may be lowered so as to permit the presser foot 16 to contact the work material or sewing machine bed 14. With the shifted collar 28, the free travel available for the low inertia presser bar is "b", the remaining portion of the initial free travel "a" having been shifted below the retaining plate 22 as at "c" to become unusable as free travel.

While the invention has been described in its preferred embodiment, it is to be understood that the words which have been used are words of description rather than of limitation and that changes within the purview of the appended claims may be made without departing from the true scope and spirit of the invention in its broader aspect.

I claim:

1. A presser mechanism for a sewing machine having a frame including a head overlying a work support, said mechanism comprising a hollow main presser bar slidably supported by said head, a first force adjusting member carried by said head coaxial with said main presser bar, a first resilient means acting between said first force adjusting member and said main presser bar for urging said main presser bar towards said work support, a low inertia presser bar internally supported in the lower end of said hollow main presser bar, a presser foot attached to the end of said low inertia presser bar for engagement with work material supported on said work support, a second adjusting member supported coaxially with said first adjusting member, a second resilient means supported internally of said main presser bar and extending between said second adjusting member and said low inertia presser bar, and means for selectively limiting the travel of said low inertia presser bar whereby said main presser bar and said first resilient means may be brought into operation after a selected travel of said low inertia presser bar, said limiting means including a collar adjustably supported on said main presser bar, said collar limiting motion of said main presser bar through said head toward said work support.

2. A presser mechanism as claimed in claim 1 wherein said limiting means further comprises: a slot in the lower end of said hollow main presser bar extending through to the hollow interior thereof, a retaining plate secured to said low inertia presser bar and extending through said slot, said retaining plate having a height along the length of said main presser bar less than said slot by the maximum amount of travel possible by said low inertia presser bar, whereby the position of said collar on said main presser bar may be adjusted to position a portion of said slot below said retaining plate so as to provide for a selected travel less than said maximum amount.

* * * * *